US010168101B2

(12) United States Patent
Zhang et al.

(10) Patent No.: US 10,168,101 B2
(45) Date of Patent: Jan. 1, 2019

(54) CERAMIC HEAT EXCHANGE PLATE AND AIR PRE-HEATER ASSEMBLED THEREBY

(71) Applicant: CAS SUPER ENERGY TECHNOLOGY JINGJIANG LTD., Jingjiang, Jiangsu (CN)

(72) Inventors: Xinyu Zhang, Jiangsu (CN); Fengze Wang, Jiangsu (CN); Lei Zhang, Jiangsu (CN); Pei Zhu, Jiangsu (CN)

(73) Assignee: CAS SUPER ENERGY TECHNOLOGY JINGJIANG LTD., Jingjiang, Jiangsu (CN)

( * ) Notice: Subject to any disclaimer, the term of this patent is extended or adjusted under 35 U.S.C. 154(b) by 144 days.

(21) Appl. No.: 15/038,687

(22) PCT Filed: Nov. 12, 2014

(86) PCT No.: PCT/CN2014/090919
§ 371 (c)(1),
(2) Date: May 23, 2016

(87) PCT Pub. No.: WO2016/045174
PCT Pub. Date: Mar. 31, 2016

(65) Prior Publication Data

US 2016/0290732 A1 Oct. 6, 2016

(30) Foreign Application Priority Data

Sep. 24, 2014 (CN) ..... 2014 1 0492678

(51) Int. Cl.
*F28D 7/02* (2006.01)
*F28F 3/00* (2006.01)
(Continued)

(52) U.S. Cl.
CPC ..... *F28D 9/0037* (2013.01); *F28D 9/02* (2013.01); *F28D 21/001* (2013.01);
(Continued)

(58) Field of Classification Search
CPC ..... F28D 9/0037; F28D 9/02; F28D 21/0003; F28D 21/001; F28F 3/02; F28F 3/048; F28F 3/10; F28F 21/04; F28F 3/04
(Continued)

(56) References Cited

U.S. PATENT DOCUMENTS 1,571,068 A * 1/1926 Stancliffe ..... F28D 7/0025 122/32
1,662,870 A * 3/1928 Stancliffe ..... F28D 9/0037 165/166
(Continued)

FOREIGN PATENT DOCUMENTS

CN 2041803 U 7/1989
CN 2081078 U 7/1991
(Continued)

*Primary Examiner* — Jason Thompson
(74) *Attorney, Agent, or Firm* — Novick, Kim & Lee, PLLC; Allen Xue

(57) ABSTRACT

The present invention relates to a ceramic heat exchange plate and an air pre-heater assembled thereby. The air pre-heater comprises a housing, the housing being provided with a lining therein and an access hole thereon. A heat exchange core is arranged inside the lining, and consists of a plurality of ceramic heat exchange plates, side connecting bolt assemblies, corner connecting bolt assemblies and side sealing strips, which are superimposed in a staggered manner; the plurality of ceramic heat exchange plates form a flue gas channel and an air channel which are intersected criss-cross, and the flue gas channel and the air channel are not communicated to each other; a flue gas inlet and a flue gas outlet are arranged on a front surface and a rear surface of the housing, respectively; and an air inlet and an air outlet are arranged on a left surface and a right surface of the housing, respectively.

1 Claim, 7 Drawing Sheets

(51) Int. Cl.

| | |
|---|---|
| ***F28F 7/00*** | (2006.01) |
| ***F28D 9/00*** | (2006.01) |
| ***F28F 3/02*** | (2006.01) |
| ***F28D 9/02*** | (2006.01) |
| ***F28D 21/00*** | (2006.01) |
| ***F28F 3/10*** | (2006.01) |
| ***F28F 21/04*** | (2006.01) |
| ***F28F 3/04*** | (2006.01) |

(52) U.S. Cl.
CPC ..... *F28D 21/0003* (2013.01); *F28F 3/02* (2013.01); *F28F 3/048* (2013.01); *F28F 3/10* (2013.01); *F28F 21/04* (2013.01); *F28F 2230/00* (2013.01); *F28F 2265/26* (2013.01)

(58) Field of Classification Search
USPC ..... 165/166, 165
See application file for complete search history.

(56) References Cited

U.S. PATENT DOCUMENTS 3,262,496 A * 7/1966 Bawabe ..... F28D 9/0068 165/166
4,083,400 A 4/1978 Dziedzic et al.
4,130,160 A * 12/1978 Dziedzic ..... F28D 9/0037 165/166
4,488,920 A 12/1984 Danis
4,681,157 A * 7/1987 Schwarz ..... F28F 7/02 165/145
5,228,515 A * 7/1993 Tran ..... F28D 9/0037 165/166
6,267,176 B1 * 7/2001 Bolla ..... F28D 9/0062 165/166
2009/0071638 A1 * 3/2009 Murayama ..... F24F 3/147 165/166
2010/0006274 A1 * 1/2010 Cho ..... F28D 9/0037 165/166
2012/0325445 A1 * 12/2012 Dinulescu ..... B21D 51/52 165/166

FOREIGN PATENT DOCUMENTS

CN 2194497 Y 4/1995
CN 1876597 A 12/2006
CN 201443778 U 4/2010
CN 102269420 A 12/2011
CN 102538546 A 7/2012

* cited by examiner

CERAMIC HEAT EXCHANGE PLATE AND AIR PRE-HEATER ASSEMBLED THEREBY

TECHNICAL FIELD OF THE INVENTION

The present invention relates to the technical field of industrial furnaces, in particular to a ceramic heat exchange plate used in flue gas waste heat recovery systems of various industrial furnaces and boilers, and an air pre-heater assembled thereby.

BACKGROUND OF THE INVENTION

An air pre-heater includes a heat exchange element made of ceramic material. The heat exchanger made of ceramic material has been applied. Such heat exchangers, having an applicable temperature generally up to 1400°, are especially suitable for waste heat recovery from the high-temperature flue gas. Meanwhile, due to the corrosion resistance of the ceramic material, such heat exchangers are also suitable for waste heat recovery from the low-temperature flue gas. The technical status is as shown in the following publications:

U.S. Pat. No. 4,681,157, titled "Crossflow Heat Exchanger";

U.S. Pat. No. 4,083,400, titled "Heat Recuperative Apparatus Incorporating a Cellular Ceramic Core";

Chinese Patent ZL201010619070.7, titled "Silicon Carbide Ceramic Heat Exchange Plate and Manufacturing Method Thereof";

Chinese Utility Model Patent ZL90206446, titled "Heat Transfer Tube Assembly of Ceramic Heat Exchanger";

Chinese Patent ZL94201435, titled "Ceramic Heat Exchanger";

Chinese Patent ZL200610017968, titled "Ceramic Heat Exchanger, Ceramic Material and Production Method Thereof".

U.S. Pat. No. 4,681,157 further provides a crossflow heat exchanger, a heat exchange main body thereof is formed by laying a plurality of cube honeycomb ceramic pieces, and the air tightness of the heat exchange main body is ensured by grooves and flanges on the four sides of the side faces of the cube honeycomb ceramic pieces, sealing strips are arranged between each pair of grooves and flanges, and the contact sides of ceramic heat exchange elements are sealed by grouting. A large number of grouting-sealing joints in this heat exchanger may lead to poor air tightness thereof.

U.S. Pat. No. 4,083,400 provides two honeycomb ceramic cores for a waste heat recovery device. The first honeycomb ceramic core is formed by bonding corrugated ceramic slices and ceramic flat plate spacers with a certain thickness together, and the ceramic spacers are configured to separate flue gas and air. The second honeycomb ceramic core is formed by laminating and bonding the ceramic spacers having fins on one side together. With regard to the first core, the ceramic spacers are likely to generate an internal stress and thus to crack due to the bonding of the corrugated ceramic slices and the ceramic flat plate spacers. With regard to the second core, it may be better. However, for both cores, the volume thereof will not be too large. Because the heat exchanger in this patent is a single-core heat exchanger, it does not involve the connecting and sealing problems of a plurality of honeycomb ceramic cores. It is not suitable for manufacturing multi-core heat exchangers.

Chinese Patent ZL201010619070.7 provides a silicon carbide ceramic heat exchange plate, characterized in that a heat exchange channel of a double-loop structure is arranged on the heat exchange plate, and is an arc-shape or a linear deep groove. This patent does not involve sealing and connection among the plates; and furthermore, the thickness of a single plate and the groove depth are limited. It is not suitable for heat exchange between air and flue gas.

Chinese Patents ZL90206446, ZL94201435, ZL200610017968 provide tube-bundle type ceramic heat exchangers which are formed by combining and laying ceramic heat exchange pipes and various joint disc bricks and refractory bricks; due to the existence of a large number of seams, the gas leakage rate is high, thereby influencing the service life of the heat exchangers.

At present, ceramic tube heat exchangers have been applied to the waste heat recovery from the high-temperature flue gas, but hardly applied to the waste heat recovery from the medium- and low-temperature flue gas. Ceramic plate heat exchangers have been hardly applied to the waste heat recovery from the high-, medium- and low-temperature flue gas.

SUMMARY OF THE INVENTION

An objective of the present invention is to provide a ceramic heat exchange plate and an air pre-heater assembled thereby by the ceramic heat exchange plate. The air pre-heater is reasonable in structure and convenient to manufacture, and can improve the air tightness, corrosion resistance and wear resistance of products and greatly prolong the service life of products.

The present invention is implemented as follows: a ceramic heat exchange plate is provided, including a central heat exchange plate having a plurality of upper fins and lower fins on an upper surface and a lower surface thereof, characterized in that the central heat exchange plate has four sides and four corners; a second side and a fourth side are arranged in a lower portion of the corners, a linear sealing groove is respectively arranged in a lower portion of outsides of the second side and the fourth side, a bottom linear sealing groove is respectively arranged on the bottom of the second side and the fourth side, and a sealing groove with a U-shaped end face is formed by the linear sealing grooves in the lower portion of the outsides of the second side and the fourth side and the sealing grooves on two corners; a first side and a third side are arranged in an upper portion of the corners, a top linear sealing groove is respectively arranged on the tops of the first side and the third side, and a linear sealing groove is respectively arranged in the upper portion of the outsides of the first side and the third side, and a sealing groove with an inverted U-shaped side face is formed by the linear sealing grooves in the upper portion of the outsides of the first side and the third side and the sealing grooves on two corners; a bolt hole is respectively arranged at the centers of the four sides in a Z-axis direction, and a corner bolt hole is respectively arranged at the four corners in a Y-axis direction; the four sides have a same structure but a different mounting position and mounting direction; the four corners have a same structure and are mirror symmetrical to each other; the central heat exchange plate is an area expanding plate; the upper fins and the lower fins are respectively arranged on the upper surface and lower surfaces of the central heat exchange plate, the fin length directions of the upper fins are arranged along the X-axis, and the fin length directions of the lower fins are arranged along the Y-axis; each of the upper fins and the lower fins is configured to provide a surface area for heat transfer; the ceramic heat exchange plate is integrally formed; and side connecting bolt assemblies and corner connecting bolt assemblies are all made of ceramic material.

An air pre-heater assembled thereby by the ceramic heat exchange plate of the present invention is provided, including a housing, the housing being provided with a lining therein and an access hole thereon; a heat exchange core is arranged inside the lining, and consists of a plurality of ceramic heat exchange plates, side connecting bolt assemblies, corner connecting bolt assemblies and side sealing strips, which are superimposed in a staggered manner; the plurality of ceramic heat exchange plates form a flue gas channel and an air channel which are intersected crisscross, and the flue gas channel and the air channel are not communicated to each other; a flue gas inlet and a flue gas outlet are arranged on a front surface and a rear surface of the housing, respectively; and an air inlet and an air outlet are arranged on a left surface and a right surface of the housing, respectively.

In the present invention, two ceramic heat exchange plates are superimposed in a staggered manner; the side sealing strips are embedded in the top linear sealing grooves of the lower ceramic heat exchange plate and the bottom linear sealing grooves of the upper ceramic heat exchange plate, the middle portions of the two sides of the side sealing strips are fastened by the side connecting bolt assemblies to form a standard module; two standard modules are superimposed, and the side sealing strips are arranged inside the two superimposed linear sealing grooves, and the middle portions of the two sides of the side sealing strips are fastened by the side connecting bolt assemblies to form a split heat exchange core; I-shaped sealing grooves are formed on an end face of the split heat exchange core, and II-shaped sealing grooves are formed on side faces of the split heat exchange core; a plurality of split heat exchange cores are fastened together in a same plane by the corner connecting bolt assemblies, and I-shaped sealing strips or II-shaped sealing strip are respectively embedded between two adjacent split heat exchange cores to form a combined heat exchange core; a plurality of combined heat exchange cores are superimposed, and the side sealing strips are embedded in the superimposed linear sealing grooves, and the middle portions of the two sides of the side sealing strips are fastened by the side connecting bolt assemblies to form a heat exchange core.

The present invention is reasonable in structure and convenient to manufacture, and improves the air tightness, corrosion resistance and wear resistance of products and greatly prolongs the service life of products.

Figure 1:
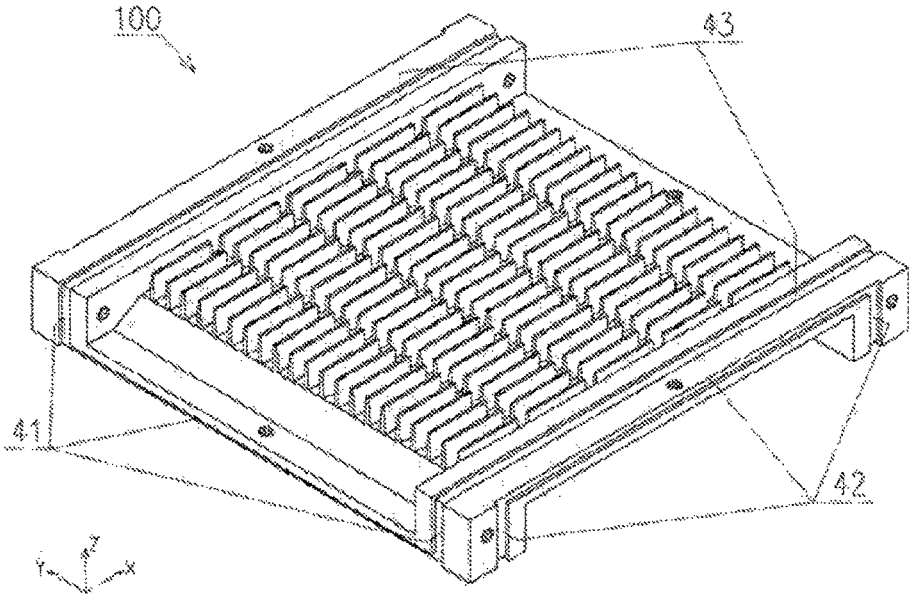
FIG. 1 is a three-dimensional top view of a ceramic heat exchange plate according to the present invention (angle of view: absolute to WCS, 225° from the X-axis, 35.3° from the XY plane)
Figure 2:
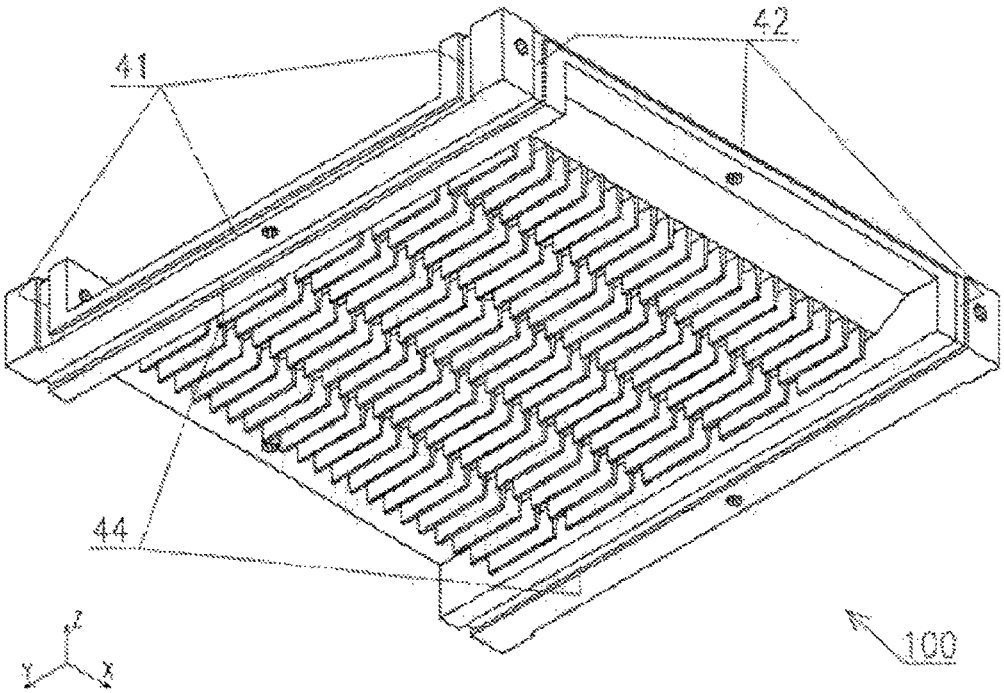
FIG. 2 is a three-dimensional bottom view of the ceramic heat exchange plate according to the present invention (angle of view: absolute to WCS, 225° from the X-axis, −35.3° from the XY plane)

1: flue gas;
2: air;
3: side sealing strip;
4: side connecting bolt assembly;
7: clay plug for a bolt hole;
8: I-shaped sealing strip;
9: corner connecting bolt assembly;
10: II-shaped sealing strip;
20: housing;
21: lining;
22: access hole;
23: access hole connecting member;
41: sealing groove with a U-shaped end face;
42: sealing groove with an inverted U-shaped side face;
43: top linear sealing groove;
44: bottom linear sealing groove;
45: I-shaped sealing groove;
46: II-shaped sealing groove;
100: ceramic heat exchange plate;
101: first corner;
102: second corner;
103: third corner;
104: fourth corner;
111: first side;
112: second side;
113: third side;
114: fourth side;
120: central heat exchange plate;
121: upper fin;
122: lower fin;
141: first corner bolt hole;
142: second corner bolt hole;
143: third corner bolt hole;
144: fourth corner bolt hole;
151: first side bolt hole;
152: second side bolt hole;
153: third side bolt hole;
154: fourth side bolt hole;
200: standard module;
300: split heat exchange core; and
900: heat exchange core.

DETAILED DESCRIPTION OF THE INVENTION

The present invention will be further described as below with reference to the accompanying drawings.

Referring to the drawings, a ceramic heat exchange plate is provided, including a central heat exchange plate 120 having a plurality of upper fins 121 and lower fins 122 on an upper surface and a lower surface thereof, characterized in that the central heat exchange plate has four sides and four corners; a second side 112 and a fourth side 114 are arranged in a lower portion of the corners, a linear sealing groove is respectively arranged in a lower portion of outsides of the second side 112 and the fourth side 114, a bottom linear sealing groove 44 is respectively arranged on the bottom of the second side 112 and the fourth side 114, and a sealing groove 41 with a U-shaped end face is formed by the linear sealing grooves in the lower portion of the outsides of the second side 112 and the fourth side 114 and the sealing grooves on two corners; a first side 111 and a third side 113 are arranged in an upper portion of the corners, a top linear sealing groove 43 is respectively arranged on the tops of the first side 111 and the third side 113, and a linear sealing groove is respectively arranged in the upper portion of the outsides of the first side 111 and the third side 113, and a sealing groove 42 with an inverted U-shaped side face is formed by the linear sealing grooves in the upper portion of the outsides of the first side 111 and the third side 113 and the sealing grooves on two corners; a bolt hole is respectively arranged at the centers of the four sides in a Z-axis direction, and a corner bolt hole is respectively arranged at the four corners in a Y-axis direction; the four sides have a same structure but a different mounting position and mounting direction; the four corners have a same structure and are mirror symmetrical to each other; the central heat exchange plate 120 is an area expanding plate; the upper fins 121 and the lower fins 122 are respectively arranged on the upper surface and lower surfaces of the central heat exchange plate 120, the fin length directions of the upper fins 121 are arranged along the X-axis, and the fin length directions of the lower fins 122 are arranged along the Y-axis; the ceramic heat exchange plate 100 is integrally formed; and side connecting bolt assemblies 5 and corner connecting bolt assemblies 9 are all made of ceramic material. An air pre-heater assembled by the ceramic heat exchange plate is provided, including a housing 20, the housing 20 being provided with a lining 21 therein and an access hole 22 thereon, characterized in that a heat exchange core 900 is arranged inside the lining 21, and consists of a plurality of ceramic heat exchange plates 100, side connecting bolt assemblies 4, corner connecting bolt assemblies 9 and side sealing strips 3, which are superimposed in a staggered manner; the plurality of ceramic heat exchange plates 100 form a flue gas channel and an air channel which are intersected crisscross, and the flue gas channel and the air channel are not communicated to each other; a flue gas inlet and a flue gas outlet are arranged on a front surface and a rear surface of the housing 20, respectively; and an air inlet and an air outlet are arranged on a left surface and a right surface of the housing 20, respectively. Two ceramic heat exchange plates 100 are superimposed in a staggered manner; the side sealing strips 3 are embedded in the top linear sealing grooves 43 of the lower ceramic heat exchange plate and the bottom linear sealing grooves 44 of the upper ceramic heat exchange plate, the middle portions of the two sides of the side sealing strips 3 are fastened by the side connecting bolt assemblies 5 to form a standard module 200; two standard modules 200 are superimposed, and the side sealing strips 3 are arranged inside the two superimposed linear sealing grooves, and the middle portions of the two sides of the side sealing strips 3 are fastened by the side connecting bolt assemblies 5 to form a split heat exchange core 300; I-shaped sealing grooves 45 are formed on an end face of the split heat exchange core, and II-shaped sealing grooves 46 are formed on side faces of the split heat exchange core; a plurality of split heat exchange cores 300 are fastened together in a same plane by the corner connecting bolt assemblies 9, and I-shaped sealing strips 8 or II-shaped sealing strip 10 are respectively embedded between two adjacent split heat exchange cores 300 to form a combined heat exchange core; a plurality of combined heat exchange cores are superimposed, and the side sealing strips 3 are embedded in the superimposed linear sealing grooves, and the middle portions of the two sides of the side sealing strips 3 are fastened by the side connecting bolt assemblies 5 to form a heat exchange core 900.

Figure 4:
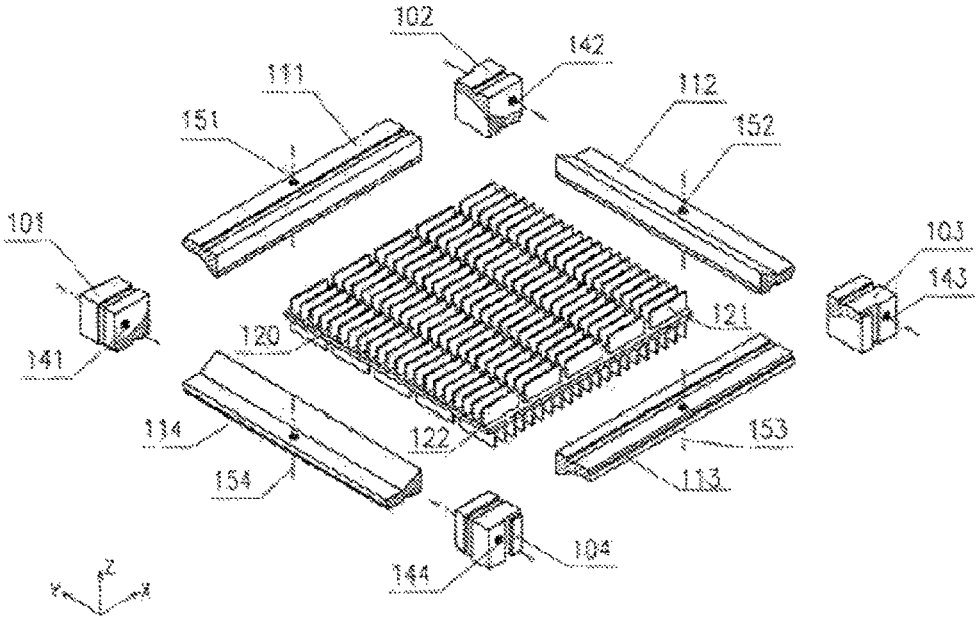
FIG. 4 is an exploded view of the ceramic heat exchange plate of FIG. 1.

In the specific implementation, the three-dimensional size of the ceramic heat exchange plate 100 is 400 mm long, 400 mm wide and 50 mm high. The top sealing groove 43 and the bottom sealing groove 44 have a groove width of 10 mm and a groove depth of 3 mm. As shown in an exploded view of the ceramic heat exchange plate 100 of FIG. 4, the ceramic heat exchange plate 100 consists of a central heat exchange plate 120, upper fins (121), lower fins (122), and four corners (101, 102, 103, 104) and four sides (111, 112, 113, 114), the middle portion is a heat transfer portion, and the four sides and the four corners are bearing, sealing and connecting portions. As shown in FIG. 4, the fin length directions of the upper fins 121 and the lower fins 122 of the central heat exchange plate 120 form an included angle of 90°.

In the present embodiment, the heat exchange plate 120 is assumed to be 300 mm long, 300 mm wide and 6 mm thick. The size and amount of the upper fins 121 and the lower fins 122 are consistent; the length of each fin is 52 mm, the height thereof is 20 mm, and the average thickness thereof is 4 mm. Both the upper fins 121 and the lower fins 122 are arranged in 21 rows and 5 columns, and have a row spacing of 14 mm and a column spacing of 10 mm.

The four corners (101, 102, 103, 104) are mirror symmetric to each other. The four sides (111, 112, 113, 114) have a completely consistent structure but a different mounting position and mounting direction, the first side 111 and the third side 113 are mirror symmetric to each other, and the second side 112 and the fourth side 114 are mirror symmetric to each other. With respect to the central heat exchange plate 120, the first side 111 and the third side 113 are arranged above a lower surface of the central heat exchange plate 120, and it is manifested in that the both sides move upward; the second side 112 and the fourth side 114 are arranged below an upper surface of the central heat exchange plate 120, and it is manifested in that the both sides move downward.

Figure 3:
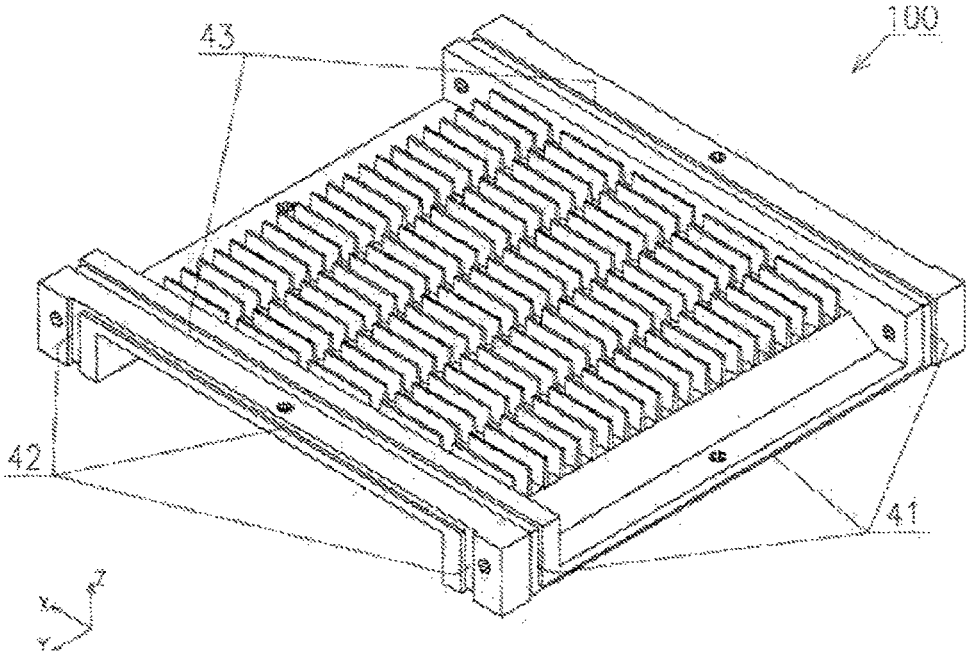
FIG. 3 is a three-dimensional top view of the ceramic heat exchange plate of FIG. 1 after being rotated for 90° in the XY plane.
Figure 5:
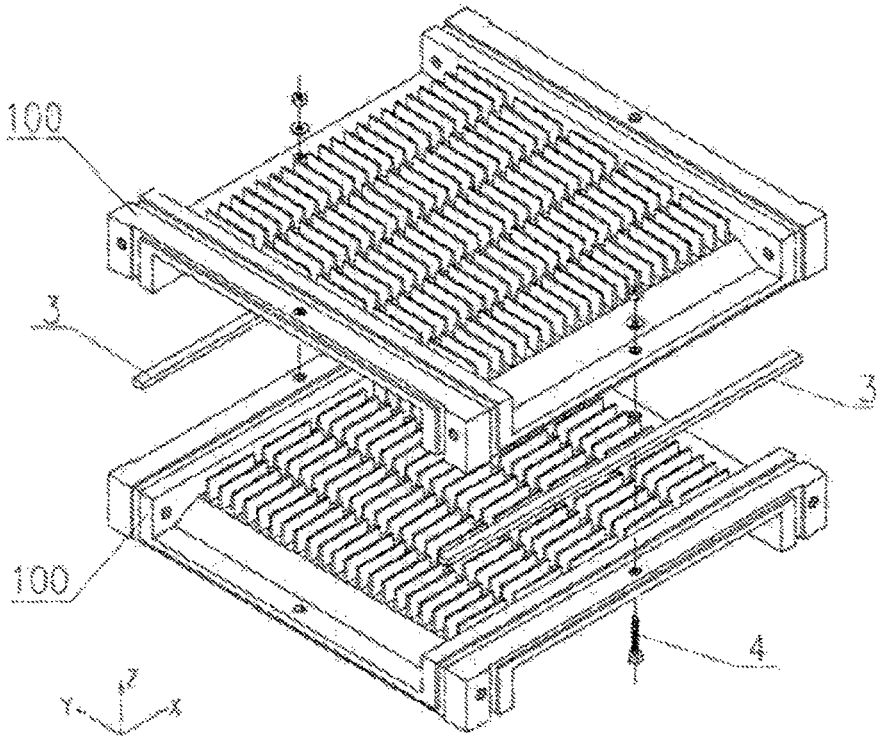
FIG. 5 is a schematic diagram of an assembly process for superimposing the ceramic heat exchange plates of FIG. 1 and FIG. 3.
Figure 6:
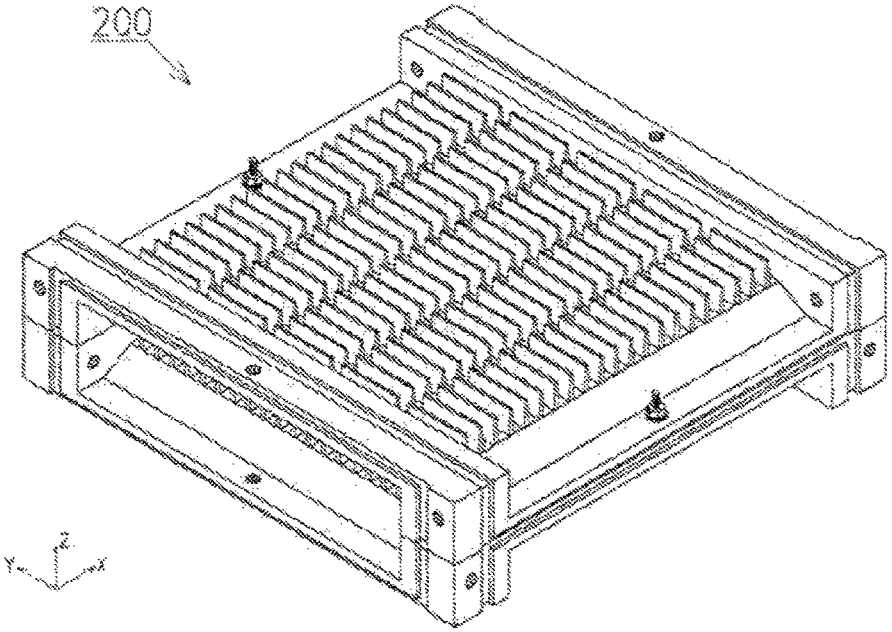
FIG. 6 is a design sketch of a standard module 200 formed by superimposing and assembling the ceramic heat exchange plates of FIG. 1 and FIG. 3.

FIG. 5 is a schematic diagram of an assembly process for superimposing two ceramic heat exchange plates 100. The ceramic heat exchange plate 100 in a direction as shown in FIG. 1 is a first one placed below, and the ceramic heat exchange plate 100 in a direction as shown in FIG. 3 is a second one placed above. Two side sealing strips 3 are respectively arranged in two linear sealing grooves 43 on the upper surface of the first ceramic heat exchange plate 100. The second ceramic heat exchange plate 100 is placed above the first ceramic heat exchange plate 100. The bolt holes on the two connected sides of the first ceramic heat exchange plate 100 and the second ceramic heat exchange plate 100 are connected by the side connecting bolt assemblies 6 to form a standard module 200 as shown in FIG. 6. The standard module 200 has connecting bolt holes in the X-Y-Z three-dimensional direction and six sealing grooves, thereby allowing for the assembling of the heat exchange cores.

When the heat exchange cores are assembled in an internal space formed by the lining 21 of the housing of the air pre-heater, an access hole connecting member 23 is demounted, and the access hole 22 of the housing is opened. In order to clearly express the assembly process, the housing 20 of the air pre-heater, and the lining 21 the housing, or the like, are omitted in FIG. 7 to FIG. 12.

Figure 7:
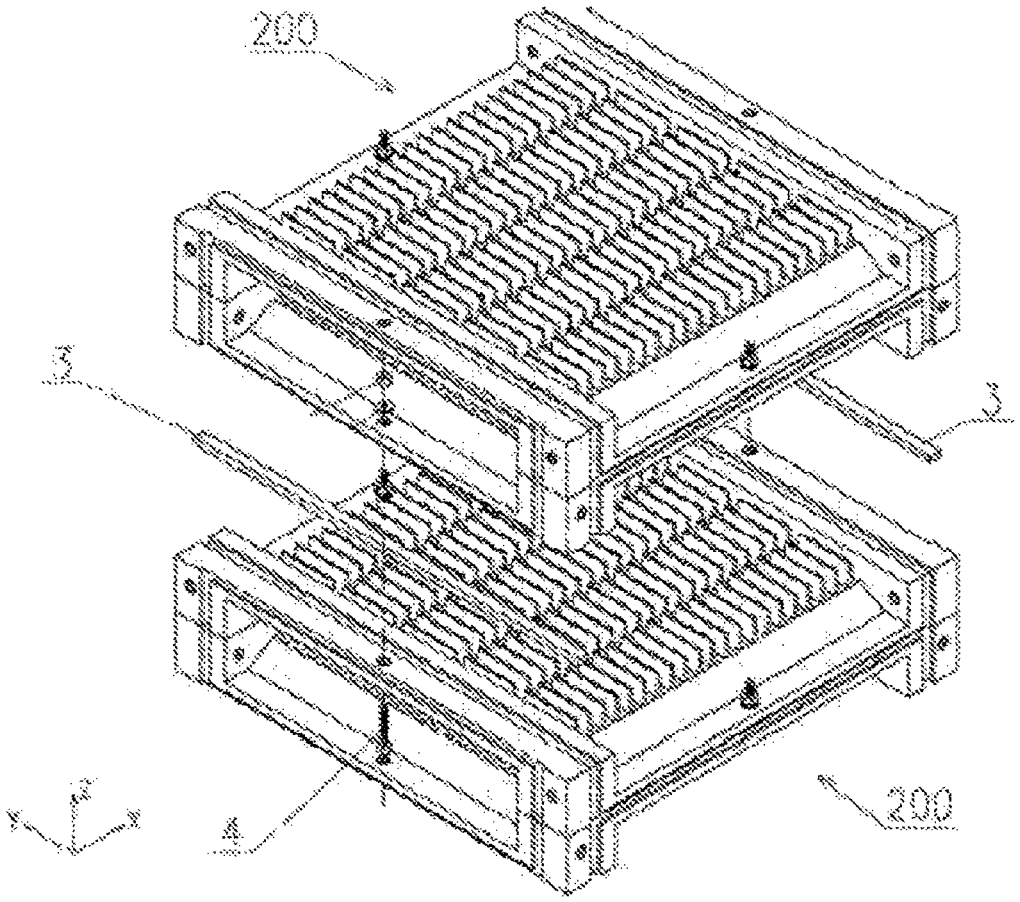
FIG. 7 is a schematic diagram of an assembly process for superimposing two standard modules 200.

FIG. 7 is a schematic diagram of an assembly process for superimposing two standard modules 200. The lower standard module 200 is regarded as a first one, and the upper standard module 200 is regarded as a second one.

Figure 8:
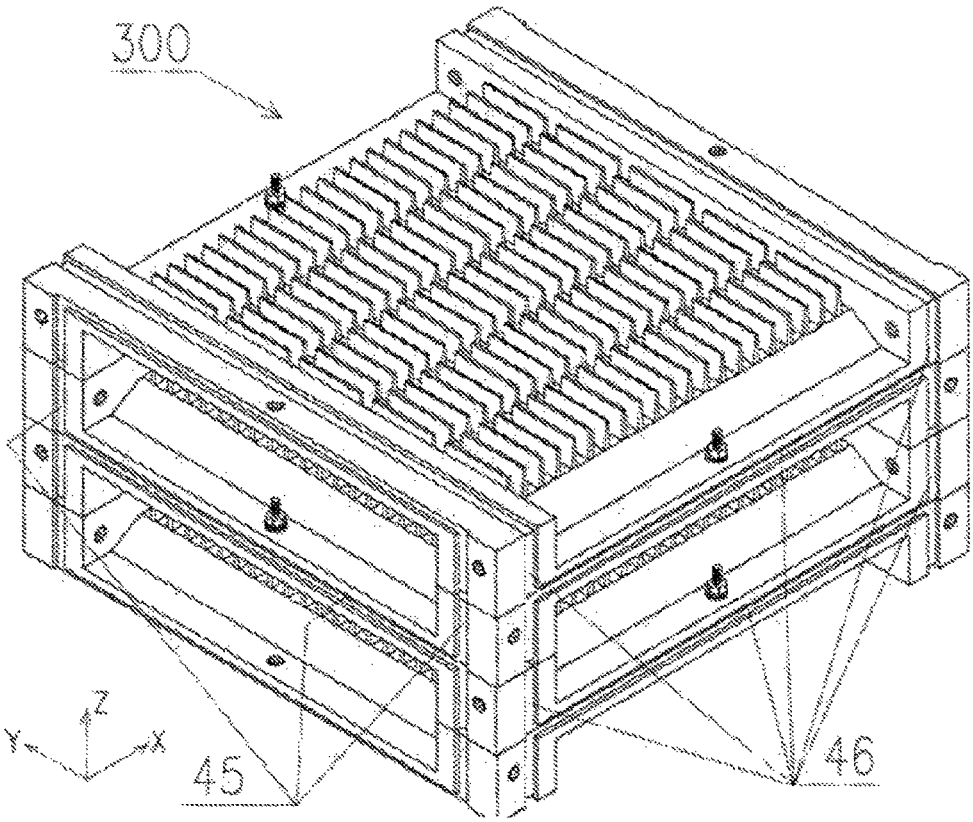
FIG. 8 is a design sketch of a heat exchange core 300 obtained by superimposing and assembling two standard modules 200.

First, positioning: the first standard module 200 is accurately placed in a beginning assembling position inside the air pre-heater;

second, placement of the sealing strips: two side sealing strips 3 are respectively placed in two linear sealing grooves 43 on the upper surface of the first standard module 200;

third, superimposing: the second standard module 200 is placed above the first standard module 200, as shown; and fifth, mounting of bolts: the bolt holes on the two connected sides of the first standard module 200 and the second standard module 200 are connected by the side connecting bolt assemblies 6 to form a heat exchange core 300 as shown in FIG. 8. On the end face of the heat exchange core 300 as shown in FIG. 8, two U-shaped sealing grooves 41 and two inverted U-shaped sealing grooves 42 are combined to form an I-shaped sealing groove 45. On the side faces thereof, the two U-shaped sealing grooves 41 and the two inverted U-shaped sealing grooves 42 are combined to form a II-shaped sealing groove 46.

Figure 9:
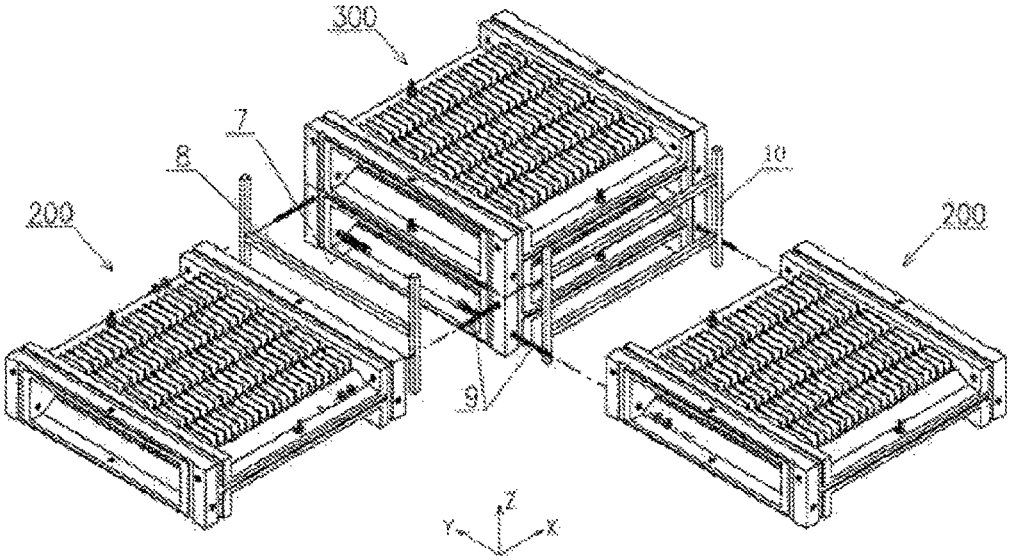
FIG. 9 is a schematic diagram of an assembly process for continuously assembling standard modules 200 on end faces and side faces of the heat exchange core 300 of FIG. 8.

FIG. 9 is a schematic diagram of an assembly process for continuously assembling standard modules 200 on the end faces and the side faces of the heat exchange core 300. In the coordinate systems as shown in FIG. 9, the end face of the heat exchange core 300 is in the YZ plane, and a side face thereof is in the ZX plane.

Figure 11:
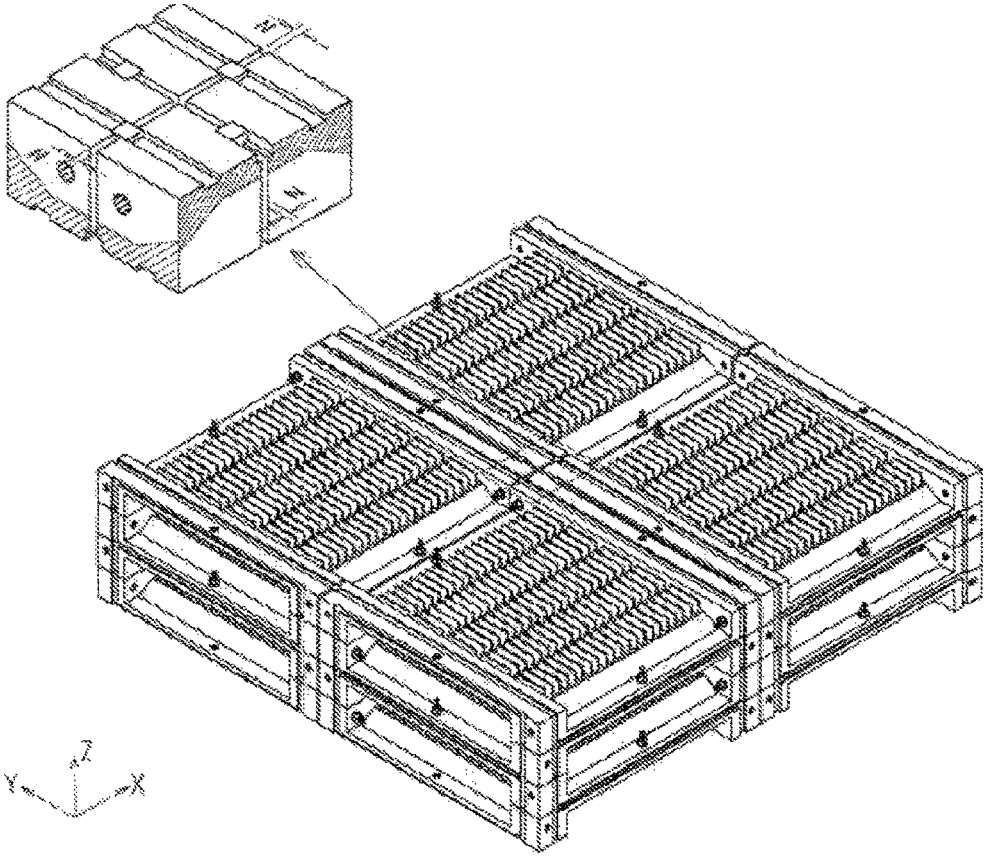
FIG. 11 is a combined heat exchange core obtained by continuously assembling standard modules 200 in a three-dimensional direction on the basis of the combined one of FIG. 10.

Sixth, mounting of sealing strips: I-shaped sealing strips 8 and II-shaped sealing strips 10 are respectively placed inside the I-shaped sealing grooves 45 on the end face of the heat exchange core 300 and II-shaped sealing grooves 46 on the side faces thereof;

seventh, plugging the unused bolt holes: as shown in FIG. 9, all bolt holes in which bolts cannot be mounted are sealed by using a clay plug for a bolt hole 7 for preventing air leakage, and the clay plug for a bolt hole 7 is made of unshaped refractory material;

Eighth, mounting of the side faces: the bolt holes on the side faces are mounted first because they are located beneath; standard modules 200 are assembled on the side faces of the heat exchange core 300, and the heat exchange core 300 and the standard modules 200 are connected together by the corner connecting bolt assemblies 9 through the corresponding bolts of the heat exchange core 300 and the standard modules 200; and during connection, a thermal expansion spacing having a value of N is reserved between the heat exchange core 300 and the standard modules 200, as detailed in a partially enlarged view in FIG. 11;

Ninth, mounting of the end face: standard modules 200 are assembled on the end face of the heat exchange core 300, and the heat exchange core 300 and the standard modules 200 are connected together by the corner connecting bolt assemblies 9 through the corresponding bolts of the heat exchange core 300 and the standard modules 200; during connection, a thermal expansion spacing having a value of N is reserved between the heat exchange core 300 and the standard modules 200, as detailed in a partially enlarged view in FIG. 11.

Figure 10:
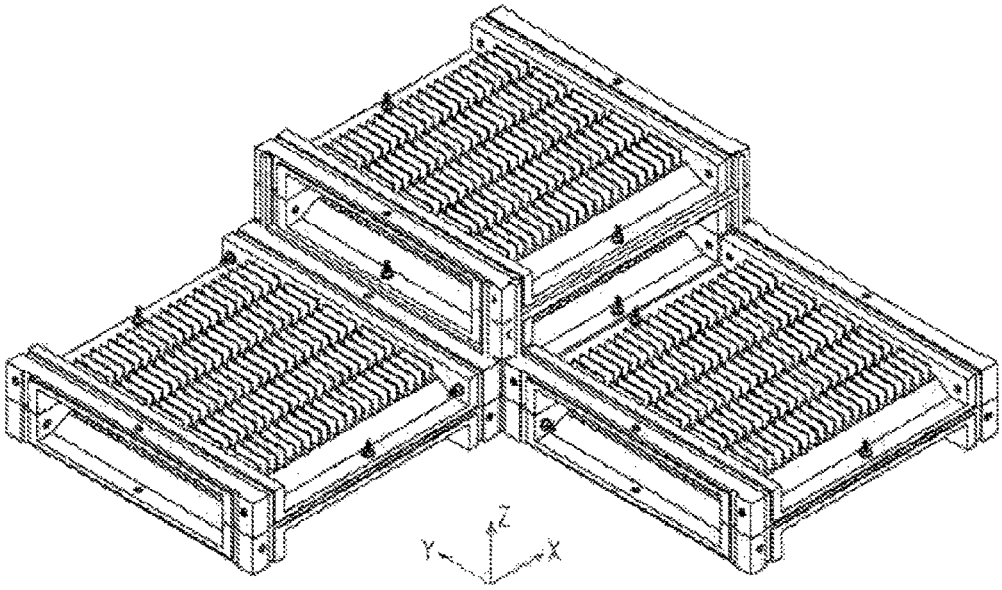
FIG. 10 is a design sketch of FIG. 9 at the end of assembly.

At the end of the above processes, a design sketch as shown in FIG. 10 may be obtained. Design sketches of FIG. 11 and FIG. 12 may be obtained by continuously assembling standard modules 200 according to the above processes on the basis of FIG. 10.

Figure 12:
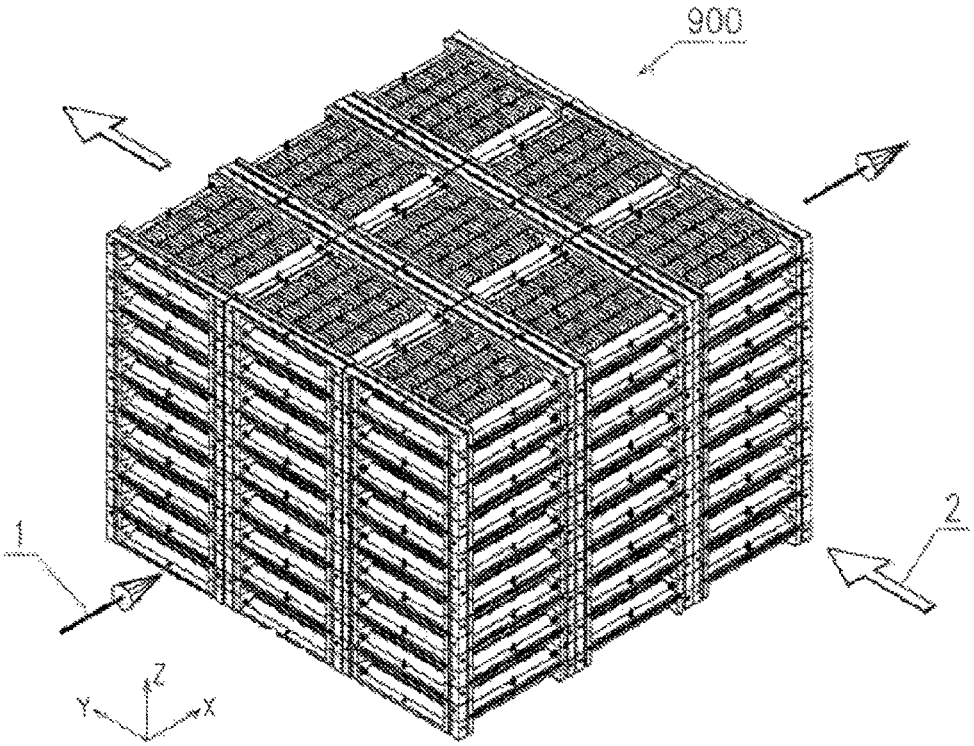
FIG. 12 shows a heat exchange core 900.

FIG. 12 is an assembled heat exchange core 900. In the coordinate systems as shown in FIG. 12, two flow channels in the X-axis direction and the Y-axis direction which are not communicated to each other are provided in the heat exchange core 900, an end face of the heat exchange core 900 is in the YZ plane, and a side face thereof is in the ZX plane. When in operation, flue gas 1 enters the channel in the X-axis direction of the heat exchange core 900 from the front end face, and flows out from the rear end face; air 2 enters the channel in the Y-axis direction of the heat exchange core 900 from the front side face, and flows out from the rear side face.

Figure 13:
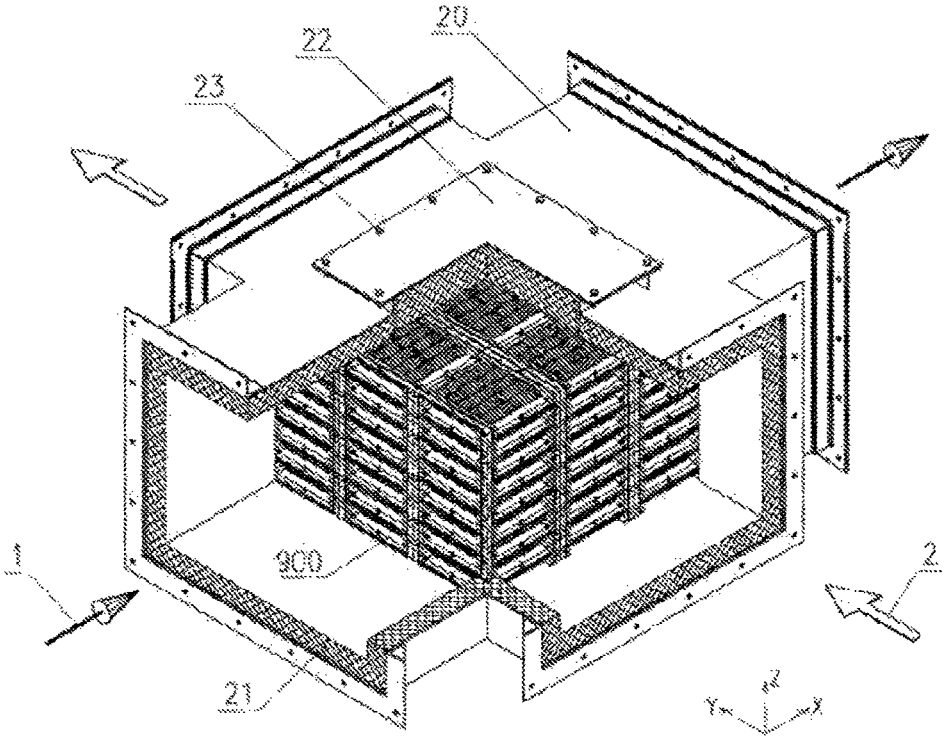
FIG. 13 is a structure diagram of an air pre-heater.

FIG. 13 is a design sketch of an air pre-heater according to the present invention. At this moment, the heat exchange core 900 has been assembled in the housing 20 and the lining 21 of the housing, and the access hole 22 has been mounted through a connecting member 23. In the coordinate systems as shown in FIG. 13, the channel in the X-axis direction of the air pre-heater is a flue gas 1 channel and the channel in the Y-axis direction of the air pre-heater is an air 2 channel. The heat exchange between flue gas 1 and air 2 is realized by the heat exchange cores inside the air pre-heater.

The ceramic heat exchange plate of the present invention is made of ceramic material with excellent thermal conductivity, for example, silicon carbide ceramic, silicon nitride ceramic, combination of silicon nitride and silicon carbide, or silicon carbide composite material.

The bolt assemblies used in the present invention are also made of ceramic material with excellent thermal conductivity, in order to ensure high-temperature resistance and corrosion resistance.

In the ceramic air pre-heater of the present invention, the ceramic heat exchange plates inside the heat exchange cores may moderately have free expansion and contraction to release the thermal stress of the ceramic heat exchange plates and to prevent the ceramic heat exchange plates from cracking; meanwhile, the joints between the ceramic heat exchange plates are always sealed to solve the problem of high gas leakage rate of similar air pre-heaters. In the flue gas waste heat recovery systems of various industrial furnaces and boilers, the air pre-heater assembled by the ceramic heat exchange cores may be used for waste heat recovery from the high-temperature flue gas and the medium- and low-temperature flue gas.

The invention claimed is:

1. An air pre-heater, comprising a housing (20) and a heat exchange core (900), wherein the housing (20) comprises a lining (21), an access hole (22), a flue gas inlet, an air inlet, a flue gas outlet, and an air outlet, wherein the heat exchange core (900) is integrally sintered and comprises a plurality of standard modules (200) assembled together along an X-axis, a Y-axis, or a Z-axis, wherein each of the plurality of the standard modules (200) comprises: a first ceramic heat exchange plate and the second ceramic heat exchange plate, wherein each of the first ceramic heat exchange plate and the second ceramic heat exchange plate comprises:

a central heat exchange plate (120) having a flat plate with a first face and a second face that are opposite to each other;

four sides consisting of a first side (111), a second side (112), a third side (113), a fourth side (114);

four corners consisting of a first corner (101), a second corner (102), a third corner (103), and a fourth corner (104);

a first plurality of fins (121), the first side (111), and the third side (113) disposed on the first face of the flat plate in a direction parallel to the X-axis; and a second plurality of fins (122), the second side (112), and the fourth side (114) disposed on the second face of the flat plate in a direction parallel to the Y-axis, wherein each of the four sides has a bolt hole located thereon, and each bolt hole is oriented along the Z-axis, and each of four corners has a bolt hole located thereon and oriented along the Y-axis, wherein the four sides, the four corners, and the central heat exchange plate (120) are assembled to form the first or the second ceramic heat exchange plate, wherein each of the first or the second ceramic heat exchange plate further comprises:

a pair of U-shaped grooves, one defined on the second side (112), the second corner (102), and the third corner (103), the other defined on the fourth side (114), the second corner (102), and the third corner (103);

a pair of inverted U-shaped grooves, one defined on the first side (111), the first corner (101), and the second corner (102), the other defined on the third side (113), the third corner (103), and the fourth corner (104);

a first pair of linear grooves (44), one defined on the second side (112), the second corner (102), and the third corner (103), the other defined on the fourth side (114), the second corner (102), and the third corner (103); and a second pair of linear grooves (43), one defined on the first side (111), the first corner (101), and the second corner (102), and the other defined on the third side (113), the third corner (103), and the fourth corner (104), wherein the first ceramic heat exchange plate is superimposed on the second ceramic heat exchange plate along the Z-axis while the second ceramic heat exchange plate is rotated by 90° in an XY plane formed by the X-axis and the Y-axis, thereby:

two side sealing strips (3) fill the second pair of grooves (43) of the second ceramic heat exchange plate and the first pair of grooves (44) of the first ceramic heat exchange plate, and the middle portions of each of the two side sealing strips (3) is fastened by a side connecting bolt assembly (4), wherein a first standard module (200) is superimposed on top of a second standard modules (200), thereby forming a split heat exchange core (300) that further comprises I-shaped sealing grooves (45) and II-shaped sealing grooves (46);

wherein a plurality of split heat exchange cores (300) are fastened together in the XY plane by corner connecting bolt assemblies (9), and I-shaped sealing strips (8) or II-shaped sealing strips (10) thereby forming a combined heat exchange core, and a plurality of combined heat exchange cores are stacking along the Z-axis to form the heat exchange core (900).

* * * * *